US010316547B2

(12) United States Patent
Ulrich et al.

(10) Patent No.: US 10,316,547 B2
(45) Date of Patent: Jun. 11, 2019

(54) LOCKING SYSTEM, KEY AND KEY BLANK

(71) Applicant: ABUS August Bremicker Söhne KG, Wetter-Volmarstein (DE)

(72) Inventors: Michael Ulrich, Mittelbach (DE); Sebastian Müller, Thalheim (DE); Thomas Pechmann, Oelsnitz (DE)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 478 days.

(21) Appl. No.: 14/930,943

(22) Filed: Nov. 3, 2015

(65) Prior Publication Data

US 2016/0145896 A1 May 26, 2016

(30) Foreign Application Priority Data

Nov. 10, 2014 (DE) ..... 10 2014 116 376

(51) Int. Cl.
*E05B 19/00* (2006.01)
*E05B 27/00* (2006.01)
(Continued)

(52) U.S. Cl.
CPC ..... *E05B 19/0094* (2013.01); *E05B 19/0023* (2013.01); *E05B 19/0035* (2013.01);
(Continued)

(58) Field of Classification Search
CPC ..... E05B 19/0094; E05B 19/0023; E05B 19/0035; E05B 19/04; E05B 27/00;
(Continued)

(56) References Cited

U.S. PATENT DOCUMENTS 2,179,947 A * 11/1939 Miller ..... E05B 27/00 70/338
3,516,271 A * 6/1970 Nelson ..... E05B 27/005 70/276

(Continued)

FOREIGN PATENT DOCUMENTS

AT 396957 B * 1/1994 ..... E05B 27/00
AT 004293 5/2001

(Continued)

*Primary Examiner* — Suzanne L Barrett
(74) *Attorney, Agent, or Firm* — Harness, Dickey & Pierce, P.L.C.

(57) ABSTRACT

A locking system comprises a lock cylinder which has a cylinder housing, a cylinder core rotatably supported in the cylinder housing and having a keyway, and has a plurality of tumblers which partly project into the keyway, and which furthermore comprises a key which has a key bow and a key shaft which has a shaft profile for acting on the tumblers. An abutment section is formed at the key shaft between the key bow and the shaft profile, said abutment section having an abutment profile having at least one projection and an undercut formed between the projection and the shaft profile. The lock cylinder furthermore comprises a movable counter-abutment. In this respect, the abutment section of the key and the movable counter-abutment of the lock cylinder are arranged and configured such that, on an introduction of the key into the keyway, the abutment section abuts the movable counter-abutment with at least one abutment surface within the keyway and in so doing forms the only active abutment formed at the key for limiting the introduction of the key into the keyway to a correct axial introduction depth.

34 Claims, 5 Drawing Sheets

(51) Int. Cl.
*E05B 19/04* (2006.01)
*E05B 35/00* (2006.01)

(52) U.S. Cl.
CPC ..... *E05B 19/04* (2013.01); *E05B 27/00* (2013.01); *E05B 27/0021* (2013.01); *E05B 27/0032* (2013.01); *E05B 35/001* (2013.01)

(58) Field of Classification Search
CPC ..... E05B 27/0021; E05B 27/0032; E05B 35/001; E05B 27/0082; E05B 27/0078
USPC ..... 70/493, 409, 408
See application file for complete search history.

(56) References Cited

U.S. PATENT DOCUMENTS 3,531,959 A * 10/1970 Weber ..... E05B 27/0042 70/216
3,650,132 A * 3/1972 Berube ..... E05B 27/00 70/447
3,889,501 A * 6/1975 Fort ..... E05B 47/063 361/172
4,356,713 A * 11/1982 Widen ..... E05B 27/0082 70/358
4,712,398 A * 12/1987 Clarkson ..... E05B 47/063 361/172
4,756,177 A * 7/1988 Widen ..... E05B 27/0039 70/358
4,848,115 A * 7/1989 Clarkson ..... E05B 47/063 361/172
5,131,249 A * 7/1992 Baden ..... E05B 19/0029 70/398
5,640,865 A * 6/1997 Widen ..... E05B 27/0082 70/378
5,964,112 A * 10/1999 Stefanescu ..... E05B 19/0017 70/358
6,442,986 B1 * 9/2002 Russell ..... E05B 47/063 70/278.3
7,040,126 B2 * 5/2006 Edwards, Jr. ..... E05B 19/0035 70/358
7,140,214 B2 * 11/2006 Lindstrom ..... E05B 47/0626 70/278.3
7,334,443 B2 * 2/2008 Meekma ..... E05B 47/063 307/10.2
8,205,473 B2 * 6/2012 Widen ..... E05B 19/0029 70/405
8,327,675 B2 * 12/2012 Baumann ..... E05B 27/0078 70/409
9,051,760 B2 * 6/2015 Herrmann ..... E05B 27/0017

FOREIGN PATENT DOCUMENTS

DE 3424603 A1 * 12/1984 ..... E05B 9/041
DE 9208707 U1 * 10/1993 ..... E05B 17/22
EP 0377135 A2 * 7/1990 ..... E05B 19/00
EP 0567446 A1 10/1993
EP 0637663 A1 2/1995
EP 0784138 A1 7/1997
EP 1048804 B1 1/2004
EP 2407616 B1 4/2015
FR 993427 A * 10/1951 ..... E05B 27/00
FR 2352934 A1 12/1977
GB 1385827 A * 3/1975 ..... B60R 25/02121
GB 2361505 A 10/2001

* cited by examiner

LOCKING SYSTEM, KEY AND KEY BLANK

The present invention relates to a locking system having a lock cylinder and a key; to a key for use in such a locking system; and to a key blank for manufacturing such a key.

A locking system can comprise a lock cylinder and a key. The lock cylinder can have a cylinder housing, a cylinder core rotatably supported in the cylinder housing and having a keyway, and a plurality of tumblers which partly project into the keyway of the cylinder core. The key can have a key bow (also called a key head) and a key shaft which extends, starting from the key bow, along a key axis in a key introduction direction and which has a shaft profile to act on the tumblers of the lock cylinder. Such a locking system can in particular comprise a plurality of keys and/or a plurality of lock cylinders, wherein provision can be made, on the one hand, that a respective key is suitable to open a plurality of different lock cylinders and wherein provision can be made, on the other hand, that a plurality of different keys can be suitable to open the same lock cylinder.

So that a respective key can open a respective lock cylinder, the key must first be configured with such an exact fit to the keyway of the cylinder core that at least an introduction region of its key shaft can be introduced into the keyway. The rotation of the cylinder core in the cylinder housing for opening the lock cylinder is, however, initially prevented by the tumblers which are as a rule preloaded into a position blocking the cylinder core with respect to the cylinder housing. Only when the shaft profile of the key acts on the tumblers and thus displaces them into a releasing position can the cylinder core be rotated in the cylinder housing so that the lock cylinder can be opened.

In this respect, the dimension by which a respective tumbler has to be displaced to achieve the releasing position can vary from tumbler to tumbler. For this purpose, different tumblers which differ, for example, in their lengths or in the size of a cut-out or in another manner and thus have respective different release positions can be inserted into the tumbler receivers which are provided in the cylinder core and in the cylinder housing. In this manner, different lock cylinders can be encoded differently with an otherwise like configuration by the fitting with different combinations of different tumblers.

Whether a respective key is suitable to open a lock cylinder then depends on whether the shaft profile has a suitable configuration to act on the tumblers of the lock cylinder exactly such that all the tumblers are displaced into a respective release position. The key can thus be encoded for one lock cylinder (or also for a plurality of lock cylinders) by the specific configuration of the shaft profile. The so-called secret code is therefore encoded in the shaft profile of the key in such keys.

The shaft profile alone is, however, not sufficient to ensure that all the tumblers are displaced into the respective releasing position. For this purpose, the shaft profile also has to be correctly aligned relative to the tumblers, in particular along the key axis or key introduction direction. A key fitting into the keyway can generally be introduced into the keyway at different depths within the keyway. The tumblers are, however, only displaced into the respective release position and thus only release the cylinder core for a rotation when the key is introduced into the keyway to the correct axial introduction depth and is thus aligned exactly relative to the tumblers such that regions of the shaft profile corresponding to a respective tumbler act on this respective tumbler.

It is therefore necessary to fix the correct axial introduction depth by the cooperation of the key and of the lock cylinder. The key bow, which projects out of the keyway on a completely introduced key and which is typically widened with respect to the key shaft for a better gripping of the key, can for this purpose typically form one or more abutments which abut the lock cylinder, for example, an end side of the cylinder core and/or of the cylinder housing, from the outside. Alternatively or additionally, the key tip, i.e. the end of the key shaft opposite the key bow, can also abut the end of the keyway opposite the key introduction opening. Such abutments are particularly easy to produce since only one or more simple edges have to be provided at the key bow or the key shaft only has to have a specific length.

However, this is accompanied by the fact that such keys can be copied relatively simply. Key blanks adapted for a respective lock system, for instance, can thus already have the required abutments at the key bow and/or a key shaft of the required length. Only the shaft profile then has to be transferred onto an initially non-profiled encoding section of the key shaft of a key blank for a key copy. This can take place in a largely automated manner in a copying machine. For this purpose, the original keys to be copied and a key blank matching it are clamped into the machine which then traces the vertical extent of the shaft profile of the original key and synchronously to this cuts the same vertical extent as a shaft profile into the encoding section of the key shaft of the key blank or drills it for dimple keys in which the shaft profile is located at the broad side or broad sides of the key shaft.

So that the copied shaft profile is applied axially correctly to the key blank, such a copying machine can have respective abutment surfaces at which the abutments of both the original key and of the key blank are aligned. It is achieved in this manner that the key copy produced from the key blank as a result has the same alignment of the shaft profile to the abutments as the original key. The simple copying ability of such keys reduces the security of the locking system.

It is therefore an object of the invention to provide a locking system, a key and a key blank which offer increased security and whose copying ability is made more difficult.

The object is satisfied by a locking system having the features of claim 1. In particular, an abutment section is formed at the key shaft between the key bow and the shaft profile, said abutment section having an abutment profile i.e. a dimension difference, in the axial direction. The abutment profile comprises at least one projection aligned in the key introduction direction and an undercut formed between the projection and the shaft profile. The lock cylinder furthermore comprises a movable counter-abutment, wherein the abutment section of the key and the movable counter-abutment of the lock cylinder are advantageously arranged and configured such that, on the introduction of the key into the keyway, at least one abutment surface of the abutment section (in particular an abutment surface of the projection and/or of the undercut) abuts the movable counter-abutment of the lock cylinder and in so doing forms the only active abutment formed at the key for limiting the introduction of the key into the keyway to a correct axial introduction depth. In this respect, the projection or the undercut or both can be active as an abutment or as abutments.

In addition to the shaft profile, a further profile is therefore provided, namely said abutment profile at the key, which, unlike the shaft profile, does not serve to act on the tumblers in accordance with the secret code, but rather to fix the introduction depth of the key in the keyway. The fact that a section of the key shaft has a profile means in this respect that the surface contour of this section varies in its height along the extent of the respective profiled section in a direction perpendicular to the extent and in so doing increases in size at least once and decreases in size at least once. Since the shaft profile extends along the key axis, its vertical extent therefore varies in the radial direction. This can be the case, for example, in the manner of notches or dimples. The vertical extent thus varies in the axial direction in the abutment profile which is preferably aligned radially or substantially radially to the key axis. The abutment profile consequently has at least one axially aligned projection and one undercut. The vertical extent of a respective profile can be configured in different manners, for example at least sectionally constant, stepped, linear or increasing or decreasing in a different manner. The profile can be produced by simple cutting out, for example. Different means are, however, also conceivable. The projection of the abutment profile can thus, for instance, be formed as a pin or as tongue which is connected to the key shaft.

The provision of an abutment profile makes the copying of such a key using conventional cutting machines substantially more difficult. Since the projection is aligned in the key introduction direction and consequently the undercut is also aligned substantially axially to the key axis, the abutment profile cannot be cut out of the same direction as the shaft profile which extends axially and whose vertical extent therefore varies radially. The forming of the undercut is thus in particular not possible in a simple manner.

It is furthermore a major aspect of the invention that the explained abutment section does not abut an outer surface of the lock cylinder, but rather cooperates with the movable counter-abutment within the keyway. In this manner, the reference point for the axial position of the shaft profile is displaced into the cylinder core. The copying of such key using conventional copying machines which are designed for a reference point at the end side of the cylinder core is also hereby made difficult.

Furthermore, in accordance with the invention, it is not only the reference point which is made deeper with respect to the end side of the cylinder core, is namely displaced into the interior of the cylinder core, but a special counter-abutment is rather also provided. Instead of a static counter-abutment provided at the cylinder core itself and/or at the cylinder housing, the counter-abutment is namely configured as movable in accordance with the invention. This movability advantageously makes it possible that the introduction depth of the key can be dependent on the position of the movable counter-abutment. This can be utilized for a further increase in the security of the locking system as will be explained further below. In addition, the copying of the key is made even more difficult by such a variable reference point. Due to its movability, the counter-abutment furthermore does not hinder the sliding along of the shaft profile of the key shaft disposed upstream of the abutment section.

So that the cooperation of the abutment section with the movable counter-abutment can have an advantageous effect in the explained manner, it is important that the key also does not abut the lock cylinder outside the keyway and also does not abut a static element within the keyway. For otherwise at least one further reference point would be present for the axial position of the shaft profile which would again simplify the more difficult copying of the key.

It is therefore advantageous that the abutment section or one or more abutment surfaces of the abutment section forms the only effective abutment formed at the key for limiting the introduction of the key into the keyway to a correct axial introduction depth in order hereby to ensure the correct interaction of the shaft profile with the tumblers. However, this does not preclude the fact that in general further abutments are provided at the key, for instance in the form of exposed features which may e.g. be necessary or useful in the manufacture of the key, but which are not active as abutments when the key is introduced into the keyway. The key can additionally—for example with a so-called reversible key whose key shaft is radially symmetrical to allow an introduction of the key into the keyway in two different rotational orientations of the key—generally have further abutment sections which can equally abut the movable counter-abutment within the keyway. However, only a respective one of these abutment sections forms the active abutment, i.e. the abutment actually abutting the movable counter-abutment of the lock cylinder on the introduction of the key into the keyway.

In accordance with an advantageous embodiment, the movable counter-abutment is supported in the cylinder core displaceable radially to the keyway. The abutment is consequently supported displaceable radially to the key axis with a key introduced into the keyway. In this manner, the forces acting on the movable counter-abutment on the abutment of the abutment section at the movable counter-abutment are directed in a different direction (namely axially) than the direction of movability of the counter-abutment (namely radially) so that the counter-abutment is not unintentionally displaced by the abutment itself.

The movable counter-abutment is preferably preloaded along said radial direction toward the keyway, for example by means of a compression spring likewise received in the cylinder core.

The movable counter-abutment is preferably formed as one of the tumblers of the lock cylinder, in particular as the tumbler arranged closest to the key introduction opening of the keyway. No separate movable counter-abutment thus has to be provided in addition to the tumblers provided for the locking function so that the lock cylinder can be particularly simple and/or compact. The tumblers are in particular pin tumblers which have a respective core pin and a housing pin which are arranged in the releasing position of the respective pin tumbler just completely in the cylinder core or in the cylinder housing so that their common boundary surface coincides with the common boundary surface of the cylinder core and the cylinder housing and the tumbler therefore releases the cylinder core for a rotation with respect to the cylinder housing. The tumblers can, however, also be disk tumblers or other types of tumblers.

The movable counter-abutment can, however, alternatively also only be formed (similar to the core pin of a pin tumbler) as a cylindrical pin or the like which is displaceable radially to the keyway and is preferably preloaded in a radial direction, but without cooperating with a housing pin or otherwise having the blocking function of a pin tumbler.

The abutment section is preferably aligned radially, i.e. perpendicular, to the key axis. It is, however, not absolutely necessary that the abutment section or the at least one abutment surface is aligned exactly perpendicular to the key axis. It is rather sufficient that the abutment section is aligned at least sectionally substantially radial to the key axis such that it can absorb the axial forces occurring on the abutment at the movable counter-abutment without substantial radial force actions occurring by which, for instance, the preferably radially movable counter-abutment could be displaced.

In a preferred embodiment, the shaft profile and the abutment section are aligned at least regionally radially in the same direction relative to the key axis. The shaft profile and the abutment section can in particular substantially form an L-shape aligned in a common radial direction in a side view. When the movable counter-abutment is configured as a tumbler, such a design in particular simplifies the cooperation of both the shaft profile and of the abutment section with this tumbler. This in particular applies to keys whose shaft profile is formed as notches at a narrow side of the key shaft. In contrast, it can be advantageous with dimple keys whose shaft profile is formed as dimples at a broad side of the key shaft if the abutment section is formed at a narrow side of the key shaft, that is if the shaft profile and the abutment section are aligned radially in respective directions perpendicular to one another with respect to the key axis.

The key in particular has an introduction region which can be introduced into the keyway of the lock cylinder and has an outer region adjacent thereto, wherein the abutment section is formed completely within the introduction region of the key. The introduction region is consequently defined such that it—unlike said outer region of the key—is located within the keyway when the key is completely introduced into the keyway, i.e. when the key is introduced into the keyway to the correct axial introduction depth to displace all the tumblers into the respective releasing position. The introduction region of the key can, for example, have a special cross-section which corresponds to the cross-section of the keyway perpendicular to the key introduction direction. The axial extent of the introduction region with respect to the key axis in particular exactly corresponds to the correct axial introduction depth of the key which is predetermined by the cooperation of the abutment section with the movable counter-abutment.

It is furthermore advantageous if the abutment section of the key and the movable counter-abutment of the lock cylinder are arranged such that the key bow is spaced apart from the lock cylinder (in particular from an end side of the cylinder housing or of the cylinder core) when the key is introduced into the keyway up to the correct axial introduction depth (as is predetermined by the cooperation of the abutment section with the movable counter-abutment). The key bow is therefore in particular located completely in said outer region of the key. The key bow, which is typically radially widened with respect to the key shaft to be able to be gripped better, furthermore does not form an abutment in this manner, for instance for an end side of the lock cylinder. It is thus ensured that the key bow cannot represent any reference point for the axial position of the shaft profile which simplifies the copying of the key.

In accordance with an advantageous embodiment, the shaft profile is formed as an arrangement of a plurality of notches. With such notches, the vertical extent of the profile increases or decreases continuously section-wise, with all increases and/or all decreases optionally being able to take place at the same pitch angle. The tumblers can advantageously be urged into a respective position in the radial direction due to the notches with their angled flanks despite the axial introduction movement of the key with respect to the key axis. Alternatively or additionally to this, the shaft profile can also comprise an arrangement of a plurality of dimples.

The abutment profile is in contrast preferably formed as a step or as an arrangement of a plurality of steps (in particular two steps) in which the vertical extent of the profile is stepped, that it is sectionally constant, and changes abruptly between these sections. The steps of constant height are then in particular aligned exactly perpendicular to the axial introduction movement of the key and are therefore particularly suitable as abutment surfaces. For example, said projection can have an end side extending perpendicular to the key axis, with the base of said undercut being able to form a further end side in the sense of a bottom of the corresponding step which in particular likewise extends perpendicular to the key axis. Provided that said projection has a plurality of steps, the abutment profile can have a plurality of end sides extending perpendicular to the key axis, but offset from one another in the axial direction, with said undercut being provided between the projection and the key shaft or the shaft profile. The profile of this undercut can likewise be stepped in accordance with the plurality of steps. In general, each of these plurality of end sides of the abutment section can serve as an abutment surface for abutting the movable counter-abutment. This is, however, not absolutely necessary. It is rather sufficient—and can also be of advantage—if only a single one of a plurality of end sides of the abutment section is active as an abutment surface.

Said abutment surface of the abutment section can generally be provided at the projection or at the undercut, or both at the projection and at the undercut of the abutment profile. In the last-named case, in particular two or more abutment surfaces offset relative to one another are provided and are active together as the abutment.

The abutment profile can in particular have at least one end side which is aligned perpendicular to the key axis and which forms said abutment surface or one of a plurality of abutment surfaces for abutting the movable counter-abutment of the lock cylinder. Such an end side or abutment surface can be provided at the projection of the abutment profile, for example. Provision can alternatively or additionally be made that the undercut has at least one end side which is aligned perpendicular to the key axis (for example at the base of the undercut) and which forms an abutment surface for abutting the movable counter-abutment of the lock cylinder.

In accordance with a further embodiment, the abutment profile can have at least two projections. These projections can be arranged next to one another and/or aligned in parallel with one another. The projections can furthermore be of equal length or of different length. Alternatively or additionally to the at least two projections, the abutment profile can have at least two undercuts. In such an embodiment, the complexity of the abutment profile is increased. The copying of the key is thereby advantageously made more difficult.

In a preferred embodiment, the movable counter-abutment of the lock cylinder has a counter-profile for cooperating with the abutment profile of the key. The counter-profile is in particular configured such that it is aligned in parallel with the abutment profile with a key introduced into the keyway. A stable abutment effect is achieved in this manner. The movable counter-abutment, which is configured as a pin tumbler, for example, is preferably aligned perpendicular to the key introduction direction in this respect. The counter-profile then preferably has an extent varying in the key introduction direction.

The counter-profile can in particular have an annular groove or a plurality of annular grooves whose respective cross-sections can differ in their size, depth and shape when the movable counter-abutment is a pin tumbler. Such annular grooves can be produced in a constructively simple manner.

The counter-profile of the movable counter-abutment is preferably configured completely or only regionally (i.e. only in a part region of the projection and undercut) complementary to the abutment profile of the key. The abutment profile and the counter-profile therefore have a vertical extent in the respective region which corresponds to the inverse of the respective other one. The counter-profile has a projection, for example, where the abutment profile has an undercut, and vice versa. When the abutment profile and the counter-profile are configured completely complementary, that is can come to lie substantially seamlessly at one another, a particularly large common contact area can thereby advantageously be formed.

However, the profiles are not necessarily completely complementary with one another. In accordance with an advantageous embodiment, the abutment profile of the key can only be configured regionally complementary to the counter-profile of the movable counter-abutment. This can be realized, for example, in that the respective extents of the profiles correspond in quality, but not necessary also in quantity everywhere. This is the case, for example, when the position of an elevated portion in the one profile corresponds to the position of a recess in the other profile, but the height of this elevated portion does not correspond to the depth of this recess. In such an embodiment, the abutment profile does not contact the counter-profile completely flush, but only sectionally, with a key introduced into the keyway to the correct axial introduction depth. The abutment profile can, for example, only contact the counter-profile with the projection, but not with the base of the undercut, or only with the base of the undercut, but not with the projection. This has the advantage that it cannot be seen from the key alone which sections of the abutment profile actually abut the counter-profile and thus represent a reference point for the correct axial position of the shaft profile. The actual reference point can thus be masked to make a copying of the key even more difficult. Different abutment profiles and in particular different abutment surfaces at the different keys can furthermore still be used in different lock cylinders within a locking system in order thus to increase the system versatility.

It is in particular preferred with such an embodiment if the abutment profile is only configured regionally complementary to the counter-profile such that when the abutment section abuts the movable counter-abutment, only an end side of the projection, but not a base of the undercut set back with respect to the end side, contacts the movable counter-abutment as an abutment surface and hereby forms said only active abutment for limiting the introduction of the key to the correct axial introduction depth. The projection of the abutment section can, for example, engage into said annular groove of the movable counter-abutment and can abut a peripheral surface of the base of the annular groove, with a collar of the movable counter-abutment bounding the annular groove admittedly engaging into the undercut of the abutment section, but not contacting the base of the undercut. In other words, with such an embodiment, the projection projects further with respect to the base of the undercut than the collar of the movable counter-abutment with respect to the base of the annular groove. It is hereby particularly difficult subsequently to reproduce the abutment profile by means of manual reworking after an automatic copying of the key by means of a cutting machine since, for example, the reference point for the correct removal depth is missing when the projection is filed off.

It is, however, conversely possible that the abutment profile is configured only regionally complementary to the counter-profile such that when the abutment section abuts the movable counter-abutment, only a base of the undercut set back with respect to the projection, but not an end side of the projection, contacts the movable counter-abutment as an abutment surface so that only the base of the undercut of the abutment section forms said only active abutment which defines the correct axial introduction depth on the introduction of the key into the keyway.

Since a counter-profile is provided with which the abutment profile cooperates on the abutment of the abutment section at the movable counter-abutment, an extended secret code can be encoded. For the abutment profile and the counter-profile can be configured such that the introduction of the key is limited exactly to the correct axial introduction depth in which the key opens the lock cylinder only when the abutment profile and the counter-profile cooperate in a suitable manner—which depends on the presence of a key with the correct abutment profile for a respective lock cylinder.

It is preferred in this connection if the abutment profile and the counter-profile are configured such that they interlock on an abutment of the abutment section at the movable counter-abutment at least regionally (i.e. completely or only regionally). The actual interlocking in this respect depends on whether the key has the abutment profile matching the counter-profile of the movable counter-abutment. Only if this is the case is it ensured that the abutment profile and the counter-profile interlock in a correct manner. Otherwise the key abuts on the introduction into the keyway at an introduction depth in which it—despite a possible correct shaft profile—cannot open the lock cylinder due to the incorrect axial alignment of the shaft profile relative to the tumblers. This advantageously also applies to a copied key whose abutment profile does not exactly coincide with the abutment profile of the original key.

In accordance with an advantageous embodiment, the shaft profile is formed such that, on an introduction of the key into the keyway, the movable counter-abutment is aligned for an interlocking of the counter-profile and of the abutment profile, in particular in a direction radial to the key axis. Even if the abutment profile formed at a key and the counter-profile of the movable counter-abutment are configured to match one another, it will depend on the position of the movable abutment, for example displaceable within the cylinder core, whether the abutment profile and the counter-profile are aligned relative to one another such that they can actually interlock. On an introduction of the key into the keyway, the movable counter-abutment can be acted on, for example, by the shaft profile and can thereby change its position. If the movable counter-abutment is configured as one of the tumblers, the shaft profile can, for instance, advantageously be configured exactly with respect to the abutment profile and to the counter-profile such that the movable counter-abutment adopts that position, at the latest just before the abutment profile reaches the counter-profile, in which the abutment profile and the counter-profile can interlock with an exact fit. The security of the locking system is increased due to this complex interplay of the shaft profile, abutment profile and counter-profile and the copying of the key is made more difficult, in particular when copying without knowledge of the counter-profile of the movable counter abutment.

The object of the invention is also satisfied by a key for use with a lock cylinder in a locking system in accordance with one of the described embodiments. In this respect, the key can have a key bow and a key shaft which extends, starting from the key bow, along a key axis in a key introduction direction and has a shaft profile for acting on tumblers received in the lock cylinder. An abutment section can furthermore be formed between the key bow and the shaft profile, said abutment section having an abutment profile having at least one projection aligned in the key introduction direction and having an undercut formed between the projection and the shaft profile. The abutment section in particular forms the only active abutment formed at the key for limiting the introduction of the key into a keyway of the lock cylinder to a correct axial introduction depth. The advantages of such a key named above in connection with the locking system in accordance with the invention, in particular the key's more difficult copying ability, also result independently of the respective associated lock cylinder.

The abutment section of the key is in particular aligned radially to the key axis. The shaft profile and the abutment section can furthermore be aligned radially in the same direction or in respective directions perpendicular to one another relative to the key axis. It is furthermore preferred if the key has an introduction region which can be introduced into the keyway of the lock cylinder and an outer region which is adjacent thereto and the abutment section is formed completely within the introduction region. The abutment section of the key can have at least one abutment surface for abutting a counter-abutment of the associated lock cylinder, with the abutment surface being provided at the projection and/or at the undercut of the abutment profile.

The object of the invention is furthermore also satisfied by a key blank for manufacturing such a key. In this respect, the key blank has a key bow and a key shaft which extends, starting from the key bow, along a key axis in a key introduction direction and the key blank has an encoding section for forming a shaft profile for acting on tumblers received in the lock cylinder. An abutment section is furthermore formed at the key shaft between the key bow and the encoded section, said abutment section having an abutment profile having at least one projection aligned in the key introduction direction and having an undercut formed between the projection and the encoded section. This abutment section forms the only active abutment present at the key blank for limiting the introduction of a key produced from the key blank into a keyway of the lock cylinder to a correct axial introduction depth.

The key blank therefore substantially differs from the previously described key in that instead of the shaft profile an encoding section is provided from which the shaft profile is only formed, for example by cutting or drilling, on the manufacture of a key from the key blank. The abutment profile can in this respect have one or more of the features (singly or in combination) which were described above in connection with the abutment profile of a key in accordance with the invention or of the key of a locking system in accordance with the invention, from which the advantages named there result.

The abutment section of the key blank is in particular aligned radially to the key axis. The encoding section and the abutment section can furthermore be aligned radially in the same direction or in respective directions perpendicular to one another relative to the key axis. It is furthermore preferred if the key blank has an introduction region provided for introduction into the keyway of the lock cylinder and an outer region which is adjacent thereto and the abutment section is formed completely within the introduction region. The abutment section of the key blank can have at least one abutment surface for abutting a counter-abutment of the associated lock cylinder, with the abutment surface being provided at the projection and/or at the undercut of the abutment profile.

The invention will be described in more detail in the following only by way of example with reference to the drawings.

Figure 1:
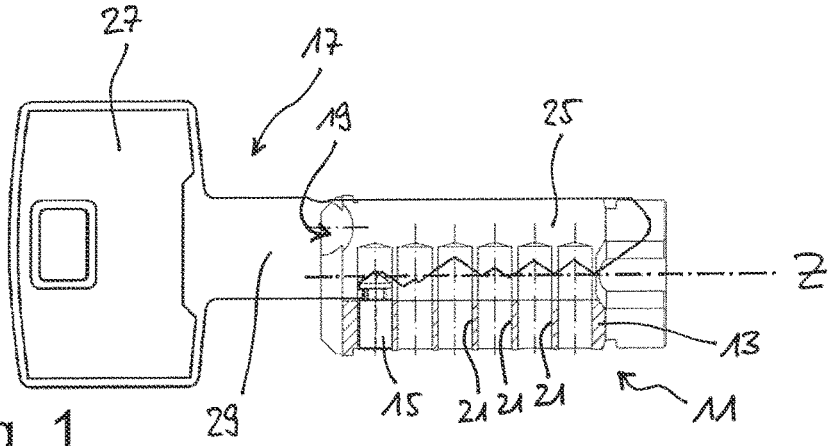
FIG. 1 shows an embodiment of a part of a locking system in accordance with the invention in a schematic cross-sectional view.

FIG. 1 shows a substantially cylindrical cylinder core 13 and a movable counter-abutment 15 of a lock cylinder 11 of a locking system in accordance with the invention. The movable counter-abutment 15 is configured as a pin tumbler, with only the core pin thereof, but not the associated housing pin being shown. The movable counter-abutment 15 could, however, also be configured without a housing pin or also completely differently in the embodiments shown. The locking system furthermore comprises a key 17 which is shown introduced into the cylinder core 13. The tumbler 15 is displaceably supported in the one of a plurality of tumbler receivers 21 in the cylinder core 13 closest to a key introduction opening 19 of the cylinder core 13, and is displaceable radially to the cylinder axis Z of the cylinder core 13. The movable counter-abutment is in this respect the first tumbler 15 of the lock cylinder 11. Further tumblers 23 (not shown here, cf. FIGS. 4 to 6) are received in the remaining tumbler receivers 21. In this respect, the first tumbler 15 and the further tumblers 23 can be formed substantially the same, that is can have approximately the same diameter. Optionally, the movable counter-abutment 15 configured as a tumbler can, however, also differ, for instance, in its dimensions from the further tumblers 23 and can, for example, be smaller in diameter.

The key 17 is introduced into a keyway 25 of the cylinder core 13. In this introduced state, the key 17 acts on the first tumbler 15 which is preloaded radially toward the keyway 25 such that the first tumbler 15 is urged radially against the preload radially outwardly into a position in which the core pin terminates flush with the cylinder core 13 and thus releases it for a rotation about its cylinder axis Z with respect to the cylinder housing, not shown, of the lock cylinder 11.

Figure 2:
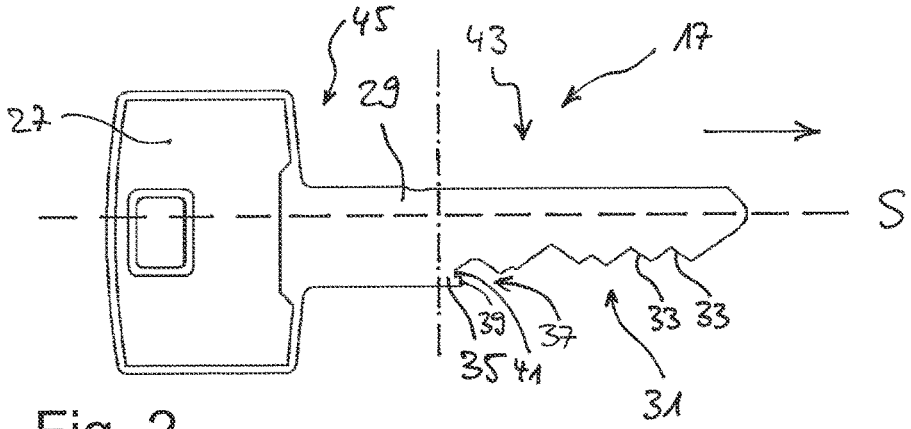
FIG. 2 shows the key of the locking system shown in FIG. 1.

As can be more clearly recognized in the individual representation of the key 17 in FIG. 2, the key 17 comprises a key bow 27 from where a key shaft 29 extends along the key axis S in a key introduction direction (arrow to the right). The key shaft 29 has a shaft profile 31, which extends in parallel with the key axis S, in the form of a plurality of notches 33 in which the secret code of the key 17 is encoded and which are suitable to act on the first and the further tumblers 15, 23 on an introduction of the key 17 into the keyway 25 and thereby to displace them radially.

An abutment section 35 is formed at the key shaft 29 between the key bow 27 and the shaft profile 31. The abutment section 35 has an abutment profile 37 in the form of a projection 39 aligned in the key introduction direction (arrow) and in the form of an undercut 41 formed between the projection 39 and the shaft profile 31 so that the abutment profile 37 is stepped (cf. in particular FIGS. 7A to 7G). Both the end side of the projection 39 preferably aligned perpendicular to the key axis S and the base of the undercut 41 preferably aligned perpendicular to the key axis S face in the key introduction direction and can thus serve (individually or together) as a respective abutment surface for abutting the first tumbler 15. The abutment section 35 extends, starting from the shaft profile 31, radially to the key axis S away from it in the same radial direction in which the shaft profile 31 is also aligned (downwardly in the Figures). In this manner, the shaft profile 31 and the abutment section 35 substantially form an L shape.

As is shown in FIG. 1, on an introduction of the key 17 into the keyway 25, the abutment section 35 abuts the first tumbler 15 within the keyway 25 so that the introduction of the key 17 is thereby limited to the shown correct axial introduction depth at which the tumblers 15, 23 release the cylinder core 13 for a rotation with respect to the cylinder housing. The abutment element 35 in this respect represents an abutment of the key 17 at which otherwise no abutments are provided for abutting elements of the lock cylinder 11 and for limiting the introduction of the key 17.

The key 17 has an introduction region 43 and adjacent thereto an outer region 45 which are delineated from one another by a chain-dotted line in FIG. 2 for illustration purposes. The introduction region 43 can be introduced into the keyway 25 of the lock cylinder 11. In contrast, the outer region 45 remains outside the keyway 25, as can be seen in FIG. 1, even with a key 17 introduced into the keyway 25 to the correct axial introduction depth. In this respect, the abutment section 35 is formed completely within the introduction region 43 to be able to abut the first tumbler 15 within the keyway 25. The key bow 27 is, in contrast, part of the outer region 45 and is moreover arranged such that it is spaced apart from the lock cylinder 11 with a key 17 introduced into the keyway 25 up to the correct axial introduction depth.

Figure 3:
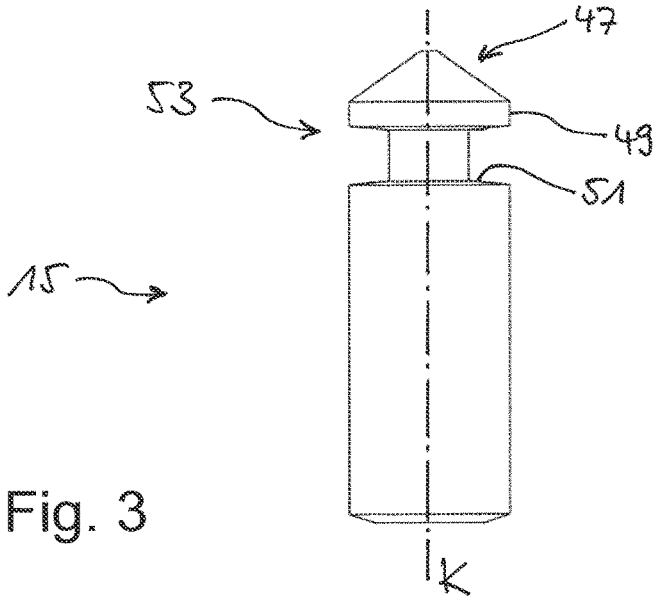
FIG. 3 shows an embodiment of the core pin of the movable counter-abutment formed as a tumbler of the lock cylinder of a locking system in accordance with the invention.

An embodiment of a movable counter-abutment 15 is shown in FIG. 3 which is configured as a core pin of the first tumbler and which substantially corresponds to the embodiment shown in FIG. 1, but is a little longer. The core pin 15 is substantially cylindrical with an obtusely angled conical tip 47. Separated from the tip 47 by a collar 49, the core pin 15 has a peripheral constriction in the form of an annular groove 51. The core pin 15 thus always has the same vertical extent independently of its rotational position within its tumbler receiver 21 (cf. FIG. 1) toward the key introduction opening 19 of the keyway 25 and can in this manner form a counter-profile 53 for cooperating with the abutment profile 37 of the key 17.

In this respect, the annular groove 51 and the collar 49 of the first tumbler 15 are formed to this extent complementary to the projection 39 and to the undercut 41 of the abutment profile 37 shown in FIGS. 1 and 2 in that the widths of the projection 39 and of the annular groove 51 coincide and the widths of the undercut 41 and of the collar 49 coincide such that the projection 39 exactly fits into the annular groove 51 and the collar 49 exactly fits into the undercut 41. In this manner, the abutment profile 37 and the counter-profile 53 interlock on an abutment of the abutment section 35 at the first tumbler 15. However, this is only possible when the first tumbler 15 adopts the position in its tumbler receiver 21 which is correct and which is radial with respect to the cylinder axis Z, in which position the core pin 15 does not block the cylinder core 13 (cf. FIG. 1). This is achieved in that the shaft profile 31 is configured accordingly and urges the core pin 15 into the shown releasing position within its tumbler receiver 21 on an introduction of the key 17 into the keyway 25, at the latest directly before the abutment profile 37 reaches the counter-profile 53.

Figure 4:
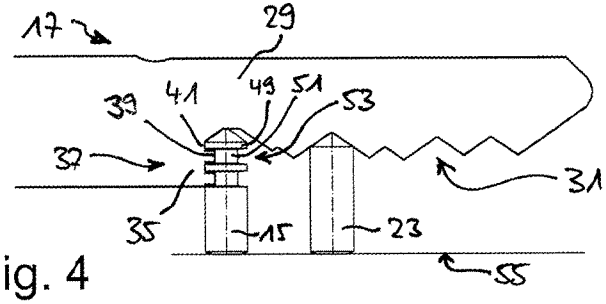
FIG. 4 shows the key shaft, the movable counter-abutment formed as a tumbler and a further tumbler of an embodiment of a locking system in accordance with the invention.

The key shaft 29 of a key 17 in accordance with the invention and the movable counter-abutment 15 configured as a core pin of the first tumbler as well as the core pin of a further tumbler 23 are each shown in different embodiments in FIGS. 4 to 6. In this respect, the embodiments substantially differ by the different configuration of the abutment profile 37 and of the counter-profile 53. The key 17 and the core pins 15, 23 are each shown in the position in which they are arranged when the key 17 is introduced into the keyway 25 up to the abutment of the abutment section 35 at the first tumbler 15.

Figure 6A:
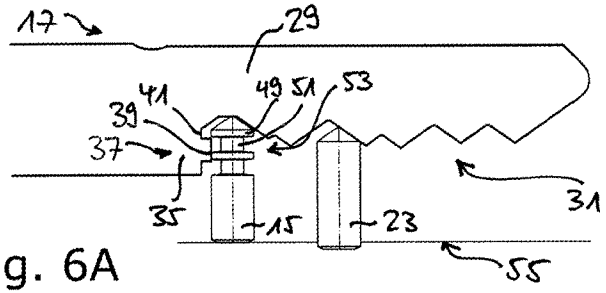
FIG. 6A shows a key shaft, a movable counter-abutment formed as a tumbler and a further tumbler of a locking system, wherein the abutment profile of the key shaft is not configured in a suitable manner for cooperating with the counter-profile of the tumbler.
Figure 6B:
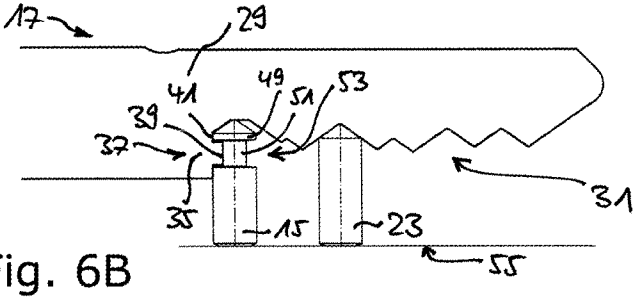
FIG. 6B shows a key shaft, a movable counter-abutment formed as a tumbler and a further tumbler of a locking system, wherein the abutment profile of the key shaft matches the counter-abutment.
Figures 7, 7A, 7B, 7C, 7D, 7E, 7F, 7G, 8A, 8B, 8C:
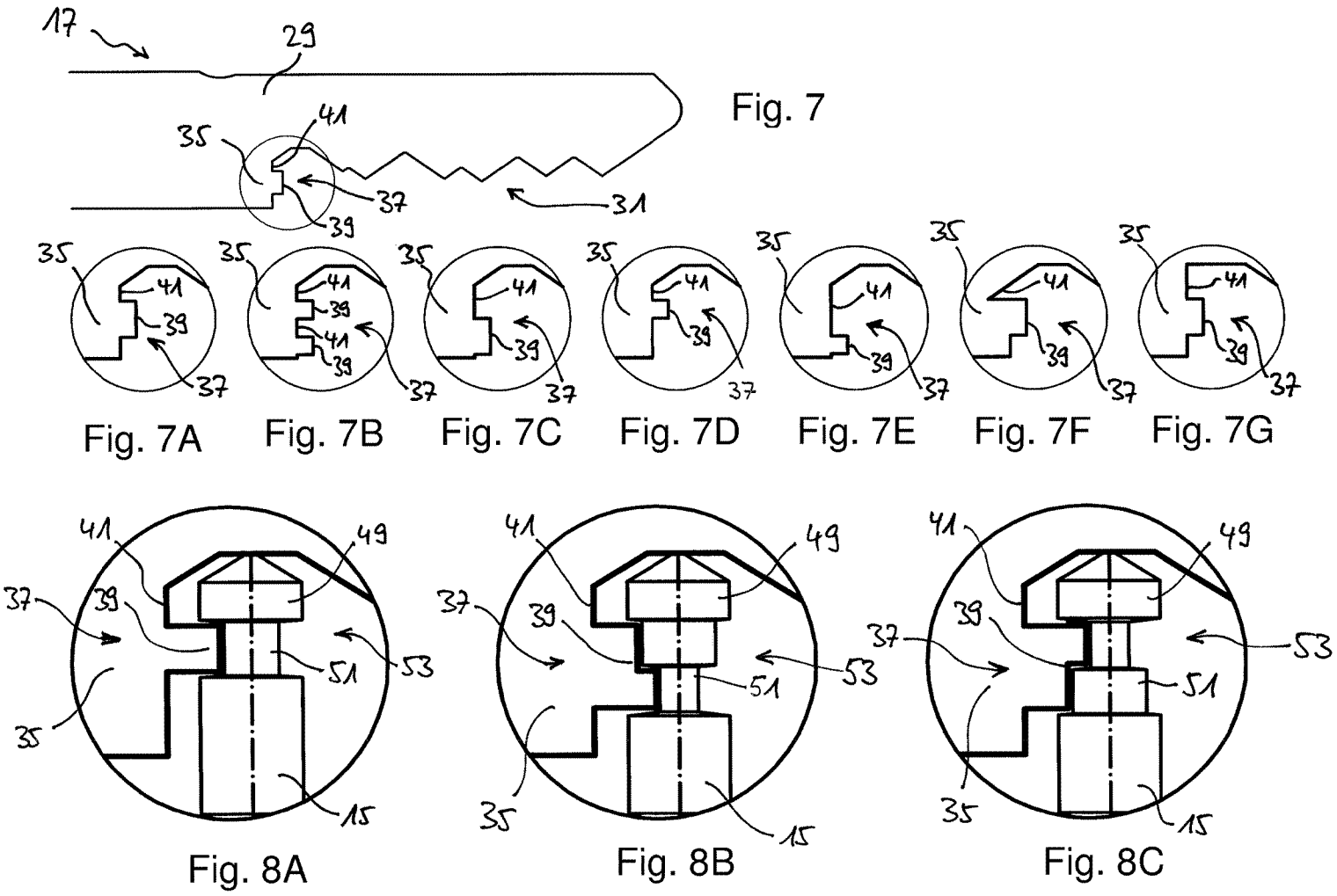
FIG. 7 shows the key shaft of an embodiment of a key in accordance with the invention.
FIGS. 7A to 7G show detailed views of various embodiments of a respective abutment section corresponding to the encircled portion in FIG. 7.
FIGS. 8A to 8C show detailed views of a respective abutment section and of a respective movable counter-abutment configured as a tumbler of further embodiments.

The abutment profile 37 of the embodiment shown in FIG. 4 has two projections 39 and two undercuts 41 (cf. also FIG. 7B). The counter-profile 53 at the core pin of the first tumbler 15 is configured as two annular grooves 51 of a corresponding width with adjacent collars 49. The two profiles 37, 53 are thus formed complementary to one another and can interlock. The introduction of the key 17 into the keyway 25 is thereby exactly limited to the correct axial introduction depth in which the shaft profile 31 is aligned relative to the tumblers 15, 23 such that it urges all the tumblers 15, 23 (of which only two are shown by way of example) into their releasing position. This releasing position can be recognized in FIGS. 4 to 6 in that the end of the respective core pin 15, 23 opposite the tip 47 terminates exactly flush with the jacket surface 55 of the cylinder core 13 (which is only indicated by a line marking the jacket surface 55 in FIGS. 4 to 6).

Figure 5A:
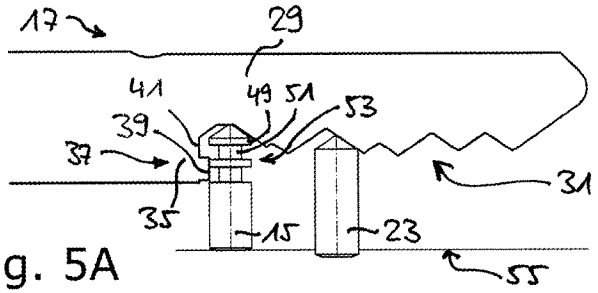
FIG. 5A shows a key shaft, a movable counter-abutment formed as a tumbler and a further tumbler of a locking system, wherein the abutment profile of the key shaft is not configured in a suitable manner for cooperating with the counter-profile of the tumbler.

In contrast, in FIGS. 5A and 6A, not all of the tumblers 15, 23 are urged into their respective releasing positions. This is due to the fact that the abutment profiles 37 of the embodiments shown in FIGS. 5A and 6A are not configured in a suitable manner for cooperating with the counter-profile 53 of the first tumbler 15 which corresponds to the first tumbler 15 shown in FIG. 1. This can have the consequence, as shown, that the abutment section 35 abuts the first tumbler 15 before the key 17 has been introduced so far into the keyway 25 that the shaft profile 31 urges all the tumblers 15, 23 into their respective release positions. In FIGS. 5A and 6A, the further tumbler 23 therefore projects beyond the jacket surface 55 of the cylinder core 13 and thus prevents an opening of the lock cylinder 11. It can be recognized from this that a part of the secret code of the locking system can also be encoded in the abutment profile 37 (or in the counter-profile 53) in addition to the shaft profile 31 (or the length of the core pins of the tumblers 15, 23).

Figure 5B:
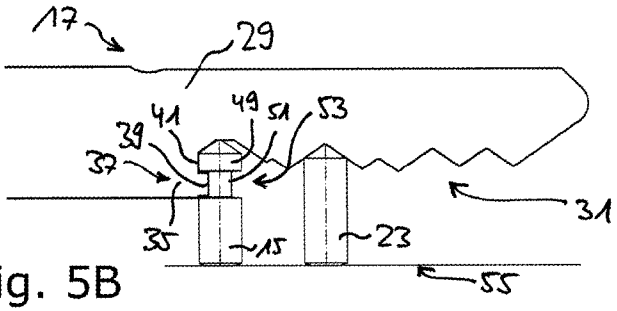
FIG. 5B shows a key shaft, a movable counter-abutment formed as a tumbler and a further tumbler of a locking system, wherein the abutment profile of the key shaft matches the counter-abutment.

The embodiments shown in FIGS. 5B and 6B differ from those in FIGS. 5A and 6A in that the respective counter-profile 53 of the core pin of the first tumbler 15 does not correspond to the counter-profile of the core pin 15 in FIG. 4, but only has an annular groove 51. The annular groove 51 is in this respect formed in its respective axial position and width such that it exactly corresponds to the projection 39 of the respective abutment profile 37. In other words, the respective abutment profile 37 of the key 17 in FIGS. 5B and 6B (as already in FIG. 4) matches the respective counter-abutment 53 of the first tumbler 15 of the lock cylinder 11 and can therefore open the lock cylinder 11.

Further embodiments of the abutment profile 37 in a plurality of detail views are shown by way of example in FIGS. 7A to 7G. In this respect, the region of the key shaft 29 which is marked by the circle in FIG. 7 and which comprises the abutment section 35 is shown magnified in each case. It can be recognized from the examples that the abutment profile 37 can differ with respect to the number of projections 39 and undercuts 41 as well as with respect to their respective positions and widths. The abutment profiles 37 are admittedly each formed as steps (with the exception of the undercut 41 in FIG. 7F). The abutment profiles 37 can, however, generally also differ with respect to their shapes.

A further embodiment is shown in FIG. 8A in which the abutment profile 37 of the key 17 and the counter-profile 53 of the movable counter-abutment 15 are admittedly complementary with respect to the sequence of elevated portions and recesses along the extent of the abutment element 35 radial to the key axis S (cf. FIG. 2) or along the core pin axis K, but not with respect to the respective dimension of the elevated portions and recesses. For the projection 39 of the abutment profile 37 extends further forward than the annular groove 51 of the counter-profile 53 is deep. Nevertheless, the abutment profile 37 and the counter-profile 53 can interlock and can limit as an abutment the introduction of the key 17 into the keyway 25 (cf. FIG. 1) to a correct axial introduction depth. Such differences from an also quantitatively exact complementary design of the abutment profile 37 and of the counter-abutment profile 53 can be used directly to mask the actual reference point active as an abutment for the correct alignment of the shaft profile 31 and thus to make a copying of the key 17 more difficult.

The detailed views of FIGS. 8B and 8C show two further embodiments in which, as in the embodiment shown in FIG. 8A, no completely complementary configuration of the abutment profile 37 and of the counter-profile 53 is provided, but the projection 39 rather projects further than the annular groove 51 is deep so that the collar 49 does not abut the base of the undercut 41. However, in these embodiments, the respective profiles 37, 53 of the abutment section 35 and of the movable counter-abutment 15 are more complex in this respect since the projection 39 does not have a constant height, but is rather of a two-step design, since a section of the projection 39 (the lower in FIG. 8B and the upper in FIG. 8C) extends further in the key introduction direction (cf. FIG. 2) than the other projection 39. The projection 39 thus has two end sides which extend perpendicular to the key axis, but are mutually offset in the axial direction. In a corresponding manner, the annular groove 51 of the counter-profile 53 is likewise configured in two steps at the movable counter-abutment 15 in a matching manner thereto. These embodiments further illustrate the variation possibilities in the design of the abutment profile 37 and of the counter-profile 53.

Figure 9:
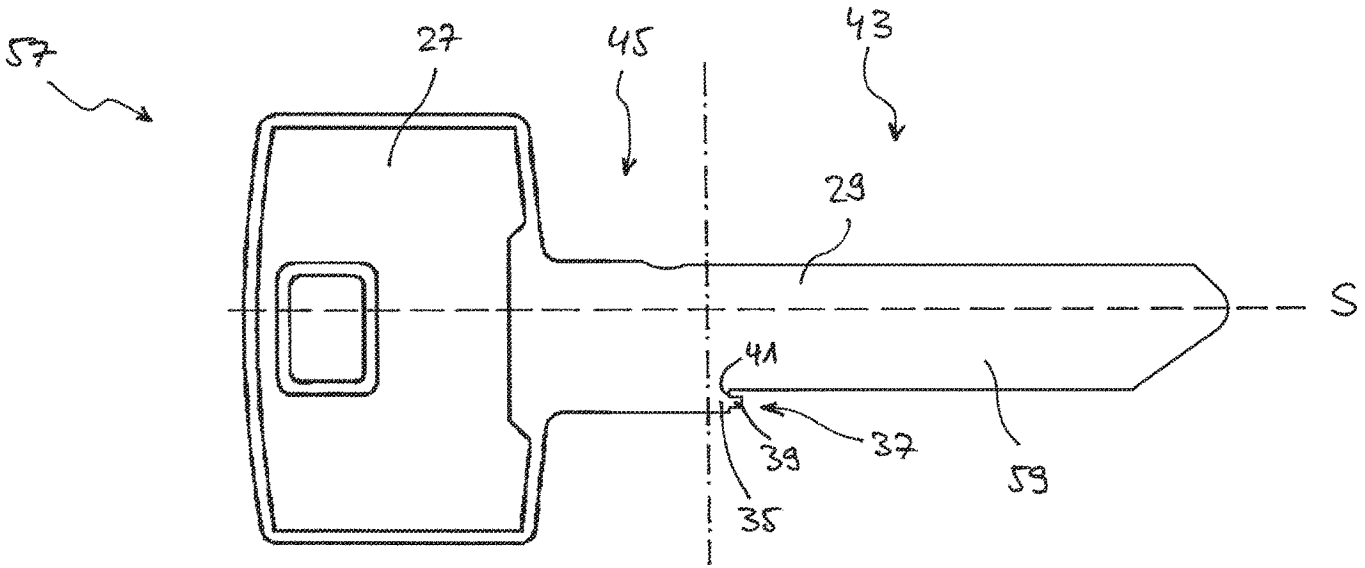
FIG. 9 shows an embodiment of a key blank in accordance with the invention.
Figure 10:
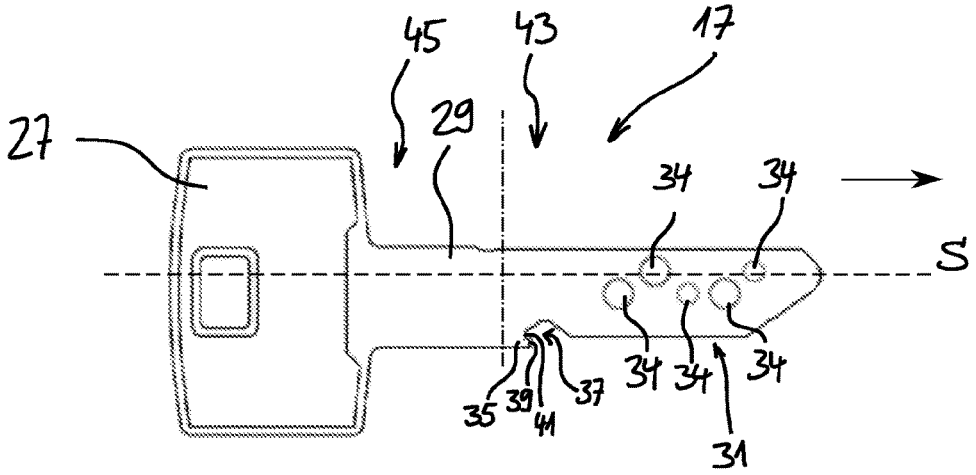
FIG. 10 shows a key of the locking system having a shaft profile formed as at least one of a plurality of notches and a plurality of dimples.

An embodiment of a key blank 57 in accordance with the invention for manufacturing a key 17 for use with a lock cylinder 11 in a locking system is shown in FIG. 9. The key blank 57 substantially differs from the key 17 shown in FIG. 2 in that it does not have any shaft profile 31 at the key shaft 29, but rather has an encoding section 59 in its place. This encoding section 59 is provided to be provided with a shaft profile 31 in the manufacture of a key 17 from the key blank 57.

The key blank 57 also has an abutment section 35 which is suitable for forming an abutment profile 37. In the embodiment of the key blank 57 shown in FIG. 9, the abutment section 35 already has an abutment profile 37 with a projection 39 and an undercut 41 formed between the projection 39 and the encoding section 59. The abutment section 35 of the key blank 57 could, however, also be blank initially, that is without an abutment profile 37 which is only formed on the manufacture of a key 17 from the key blank 57. Provision can additionally be made that the already present abutment profile 37 has to be changed or supplemented in the manufacture of a key 17 from the key blank 57 in order to match a specific counter-profile 53 in a lock cylinder 11. Further projections 39 and/or undercuts 41 may, for example, have to be added in the abutment section 35.

Like the key 17 shown in FIG. 2, the key blank 57 also has an introduction region 43 which is provided for introduction into the keyway 25 of the lock cylinder 11 and it has an outer region 45 adjacent thereto. The introduction region 43 and the outer region 45 are separated from one another by a chain-dotted line in FIG. 9. The abutment section 35 is in this respect located in the introduction region 43. In the introduction region 43, and preferably only in this region and not also in the outer region 45, the key shaft 29 of the key blank 57 can have a cross-section which differs form a simple rectangle due, for example, to longitudinal recesses formed therein, said cross-section being able to be matched to a corresponding cross-section of the keyway 25 of a lock cylinder 11 which a key 17 produced from the key blank 57 should be able to open.

REFERENCE NUMERAL LIST 11 lock cylinder
13 cylinder core
15 movable counter-abutment, core pin of the first tumbler
17 key
19 key introduction opening
21 tumbler receiver
23 core pin of a further tumbler
25 keyway
27 key bow
29 key shaft
31 shaft profile
33 notch
35 abutment section
37 abutment profile
39 projection
41 undercut
43 introduction region
45 outer region
47 tip

49 collar
51 annular groove
53 counter-profile
55 jacket surface
57 key blank
59 encoding section
K core pin axis
S key axis
Z cylinder axis

The invention claimed is:

1. A locking system comprising:

a lock cylinder (11) which has a cylinder housing, a cylinder core (13) rotatably supported in the cylinder housing and having a keyway (25), and has a plurality of tumblers (15, 23) which partly project into the keyway (25); and further comprising a key (17) which has a key bow (27) and a key shaft (29) which extends, starting from the key bow (27), along a key axis (S) in a key introduction direction and has a shaft profile (31) for acting on the tumblers (15, 23);

wherein an abutment section (35) is formed at the key shaft (29) between the key bow (27) and the shaft profile (31) and has an abutment profile (37) having at least one projection (39) aligned in the key introduction direction and having an undercut (41) formed between the projection (39) and the shaft profile (31);

wherein the lock cylinder (11) comprises a movable counter-abutment (15); and wherein the abutment section (35) of the key (17) and the movable counter-abutment (15) of the lock cylinder (11) are arranged and configured such that, on an introduction of the key (17) into the keyway (25), the abutment section (35) abuts the movable counter-abutment (15) with at least one abutment surface within the keyway (25) and in so doing forms the only abutment formed at the key (17) for limiting the introduction of the key (17) into the keyway (25) to a correct axial introduction depth.

2. A locking system in accordance with claim 1, wherein the movable counter-abutment (15) is supported in the cylinder core (13) radially displaceable to the keyway (25).

3. A locking system in accordance with claim 1, wherein the movable counter-abutment (15) is configured as one of the tumblers (15, 23) of the lock cylinder (11).

4. A locking system in accordance with claim 1, wherein the movable counter-abutment (15) is configured as the tumbler (15) arranged closest to a key introduction opening (19) of the keyway (25).

5. A locking system in accordance with claim 1, wherein the abutment section (35) is at least substantially aligned radially to the key axis (S).

6. A locking system in accordance with claim 1, wherein the shaft profile (31) and the abutment section (35) are aligned radially in the same direction or in mutually perpendicular directions with respect to the key axis (S).

7. A locking system in accordance with claim 1, wherein the key (17) has an introduction region (43) which can be introduced into the keyway (25) of the lock cylinder (11) and an outer region (45) adjacent thereto;

and wherein the abutment section (35) is formed completely within the introduction region (43).

8. A locking system in accordance with claim 1, wherein the abutment section (35) and the movable counter-abutment (15) are arranged such that the key bow (27) is spaced apart from the lock cylinder (11) when the key (17) is introduced into the keyway (25) up to the correct axial introduction depth.

9. A locking system in accordance with claim 1, wherein the shaft profile (31) is formed as at least one of a plurality of notches (33) and a plurality of dimples.

10. A locking system in accordance with claim 1, wherein the abutment profile (37) is formed as a step or as a plurality of steps.

11. A locking system in accordance with claim 1, wherein said at least one abutment surface of the abutment section (35) is provided at said at least one of the projection and the undercut of the abutment profile (37).

12. A locking system in accordance with claim 1, wherein the projection (39) has at least one end side which extends perpendicular to the key axis (S) and which forms said at least one abutment surface of the abutment section (35).

13. A locking system in accordance with claim 1, wherein the undercut (41) has at least one end side which is aligned perpendicular to the key axis (S) and which forms said at least one abutment surface of the abutment section (35).

14. A locking system in accordance with claim 1, wherein the abutment profile (37) has at least two projections (39), or at least two undercuts (41), or both at least two projections (39) and at least two undercuts (41).

15. A locking system in accordance with claim 1, wherein the movable counter-abutment (15) of the lock cylinder (11) has a counter-profile (53) adapted to cooperate with the abutment profile (37) of the key (17).

16. A locking system in accordance with claim 15, wherein the counter-profile (53) comprises one or more annular grooves (51).

17. A locking system in accordance with claim 15, wherein the counter-profile (53) is formed completely or only regionally complementary to the abutment profile (37).

18. A locking system in accordance with claim 15, wherein the abutment profile (37) is configured only regionally complementary to the counter-profile (53) such that when the abutment section (35) abuts the movable counter-abutment (15), only an end side of the projection (39), but not a base of the undercut (41) set back with respect to the end side of the projection (39), contacts the movable counter-abutment (15) as said at least one abutment surface and hereby forms said only abutment for limiting the introduction of the key (17) to the correct axial introduction depth.

19. A locking system in accordance with claim 15, wherein the abutment profile (37) and the counter-profile (53) are configured such that they interlock completely or only regionally when the abutment section (35) abuts the movable counter-abutment (15).

20. A locking system in accordance with claim 15, wherein the shaft profile (31) is configured such that, when the key (17) is introduced into the keyway (25), the movable counter-abutment (15) is aligned for an interlocking of the counter-profile (53) and of the abutment profile (37).

21. A key (17) for use in a locking system comprising a lock cylinder (11) which has a cylinder housing, a cylinder core (13) rotatably supported in the cylinder housing and having a keyway (25), and has a plurality of tumblers (15, 23) which partly project into the keyway (25), wherein the key (17) has a key bow (27) and a key shaft (29) which extends, starting from the key bow (27), along a key axis (S) in a key introduction direction and has a shaft profile (31) for acting on tumblers (15, 23) received in the lock cylinder (11);

wherein an abutment section (35) is formed at the key shaft (29) between the key bow (27) and the shaft profile (31) and has an abutment profile (37) having at least one projection (39) aligned in the key introduction direction and having an undercut (41) formed between the projection (39) and the shaft profile (31);

wherein the abutment section (35) forms the only abutment formed at the key (17) for limiting the introduction of the key (17) into the keyway (25) of the lock cylinder (11) to a correct axial introduction depth.

22. A key in accordance with claim 21, wherein the abutment section (35) is at least substantially aligned radially to the key axis (S).

23. A key in accordance with claim 21, wherein the shaft profile (31) and the abutment section (35) are aligned radially in the same direction or in mutually perpendicular directions with respect to the key axis (S).

24. A key in accordance with claim 21, wherein the key (17) has an introduction region (43) which can be introduced into the keyway (25) of the lock cylinder (11) and an outer region (45) adjacent thereto;

and wherein the abutment section (35) is formed completely within the introduction region (43).

25. A key in accordance with claim 21, wherein the shaft profile (31) is formed as at least one of a plurality of notches (33) and a plurality of dimples.

26. A key in accordance with claim 21, wherein the abutment profile (37) is formed as a step or as a plurality of steps.

27. A key in accordance with claim 21, wherein the abutment section (35) of the key (17) has at least one abutment surface for abutting a counter-abutment (15) of the associated lock cylinder (11), with said at least one abutment surface being provided at said at least one of the projection and the undercut of the abutment profile (37).

28. A key in accordance with claim 21, wherein the projection (39) has at least one end side which extends perpendicular to the key axis (S) and which forms said at least one abutment surface of the abutment section (35).

29. A key in accordance with claim 21, wherein the undercut (41) has at least one end side which extends perpendicular to the key axis (S) and which forms said at least one abutment surface of the abutment section (35).

30. A key in accordance with claim 21, wherein the abutment profile (37) has at least two projections (39), or at least two undercuts (41), or both at least two projections (39) and at least two undercuts (41).

31. A key blank (57) for manufacturing a key (17) to be used in a lock cylinder (11) which has a cylinder housing, a cylinder core (13) rotatably supported in the cylinder housing and having a keyway (25), and has a plurality of tumblers (15, 23) which partly project into the keyway (25), wherein the key blank has a key bow (27) and a key shaft (29) which extends, starting from the key bow (27), along a key axis (S) in a key introduction direction and has an encoding section (59) for forming a shaft profile (31) for acting on tumblers (15, 23) received in a lock cylinder (11);

wherein an abutment section (35) is formed at the key shaft (29) between the key bow (27) and the encoding section (59), said abutment section having an abutment profile (37) having at least one projection (39) aligned in the key introduction direction and having an undercut (41) formed between the projection (39) and the encoding section (59); and wherein the abutment section (35) forms the only abutment formed at the key blank (57) for limiting the introduction of a key (17) produced from the key blank (57) into the keyway (25) of the lock cylinder (11) to a correct axial introduction depth.

32. A key blank in accordance with claim 31, wherein the abutment section (35) is at least substantially radially aligned to the key axis (S).

33. A key blank in accordance with claim 31, wherein the encoding section (59) and the abutment section (35) are aligned radially in the same direction or in mutually perpendicular directions with respect to the key axis (S).

34. A key blank in accordance claim 31, wherein the key blank (57) has an introduction region (43) provided for introduction into the keyway (25) of the lock cylinder (11) and an outer region (45) adjacent thereto;

and wherein the abutment section (35) is formed completely within the introduction region (43).

* * * * *